United States Patent [19]

Scullin

[11] Patent Number: 4,633,876

[45] **Date of Patent: * Jan. 6, 1987**

[54] NURSING BRA

[75] Inventor: Mary E. Scullin, Forest Hills North, N.Y.

[73] Assignee: Exquisite Form Industries, Inc., New York, N.Y.

[ * ] Notice: The portion of the term of this patent subsequent to Nov. 5, 2002 has been disclaimed.

[21] Appl. No.: 669,891

[22] Filed: Nov. 9, 1984

[51] Int. Cl.[4] ..... A41C 3/04

[52] U.S. Cl. ..... 128/460; 128/510

[58] Field of Search ..... 128/460, 510, 461

[56] References Cited

U.S. PATENT DOCUMENTS

| | | | |
|---|---|---|---|
| 2,585,338 | 2/1952 | Meares | 128/460 |
| 2,928,396 | 3/1960 | O'Dell | 128/460 |
| 3,145,714 | 8/1964 | Brown | 128/460 |
| 4,550,734 | 11/1985 | Porco | 128/460 |

FOREIGN PATENT DOCUMENTS

| | | | |
|---|---|---|---|
| 1004058 | 11/1951 | France | 128/460 |

*Primary Examiner*—Doris L. Troutman

*Attorney, Agent, or Firm*—Lackenbach Siegel Marzullo & Aronson

[57] ABSTRACT

This invention relates to a brassiere for use in nursing and maternity, as well as for use as a prosthetic device. Such use requires cups which can be opened and closed easily without having to unfasten the brassiere from the wearer.

21 Claims, 12 Drawing Figures

NURSING BRA

BACKGROUND OF THE INVENTION

Heretofore, brassieres used for nursing and maternity were usually constructed with hooks, snaps, or other fastening means in order to close the brassiere cup. Fastening means, in general, require the wearer to use two hands to fasten or unfasten the fastening means. This is a disadvantage to the wearer, since a woman who is nursing has only one hand which is normally free of her baby and often she does not have a convenient place to rest her baby. Furthermore, hooks, snaps, or other fastening means can easily snag other garments or become detached during laundering. Moreover, women in general are loathe to have any such fastening means whatsoever in the vicinity of their breasts for obvious reasons as they would be extremely discomforting, as well as disconcerting in terms of looks. However, in the case of maternity and nursing brassieres, heretofore women virtually had no choice except to remove their brassieres if they did not want to have to unhook or unsnap a breast cup. The following following publications and/or patents generally relate to brassieres of this type:

| NAME | DATE | NUMBER |
|---|---|---|
| WITKOWER | OCT. 9, 1945 | U.S. Pat. No. 2,386,530 |
| ALBERTS | MAY 25, 1954 | U.S. Pat. No. 2,679,048 |
| CROXALL | OCT. 21, 1958 | U.S. Pat. No. 2,856,935 |
| RAMSELL | NOV. 5, 1968 | U.S. Pat. No. 3,409,017 |
| DERFRU | APR. 22, 1969 | U.S. Pat. No. 3,439,682 |
| O'DELL | MAR. 15, 1960 | U.S. Pat. No. 2,928,396 |
| BROWN | AUG. 25, 1964 | U.S. Pat. No. 3,145,714 |
| FARINO | JUN. 5, 1958 | Australian 221,990 |
| CHAUVIN | MAR. 25, 1952 | French 1,004,058 |

U.S. Pat. No. 2,386,530 issued to Witkower on Oct. 9, 1945, discloses a nursing brassiere with "opening" breast pockets. The pockets are formed by an openable flap, which has a hook on its upper end. The hook engages an adjustable loop on a shoulder strap in order to close the pocket.

U.S. Pat. No. 2,679,048, issued on Alberts on May 25, 1954, shows a similar arrangement. An outer layer of fabric is provided with a hook at its upper end. The hook engages a complimentary element at the upper end of an inner layer of fabric or on the lower portion of the shoulder strap in order to close the cup. The inner layer of fabric has a substantially elliptical aperture so that the cup is, in fact, open when the hook is not engaged.

U.S. Pat. No. 2,856,935, issued to Croxall on Oct. 21, 1958, shows a maternity and nursing brassiere with adjustable and detachable cups. This is accomplished using a 3-point detachable suspension arrangement. Corresponding hook and eye members provide the means of detachment.

U.S. Pat. No. 3,409,017, issued to Ramsell on Nov. 5, 1968, shows another similar brassiere with "opening" cups. The cups are secured into a closed position by engaging a cup loop on each flap with an associated buckle on a shoulder strap.

U.S. Pat. No. 3,439,682, issued to Defru on Apr. 22, 1969, shows a therapeutic brassiere in which the cups are not permanently attached or stitched at any point, but are completely removable. The cups are then attached to the body of the brassiere by means of Velcro strips.

U.S. Pat. No. 3,145,714, issued to Brown on Aug. 25, 1964 shows a brassiere formed with cups embodying a pair of segments overlapping at the inner edges of the segments, and yet free to move apart or together so as to cause the volume of the cups to vary and automatically adjust and confirm to the breasts of the wearer as required by the postures of the wearer. With such bra construction, no access is provided for the breasts.

U.S. Pat. No. 2,928,396 issued to O'Dell on Mar. 15, 1960 relates to a slip or other like garment, and a separate standard bra is worn beneath the slip like garment. This garment enables a nursing mother to expose her breast after her separate bra which supports the breasts is removed so that when an infant is presented to the breast through an opening provided by a breast covering flap folded back upon itself, the surrounding garment material of the center yoke and the flap conceal the mother's breast.

Australian Pat. No. 221,990 to Frank Farino deals with a dual purpose brassiere worn either as a maternity brassiere during pregnancy or worn without change as a conventional brassiere. The novelty of this bra is that during the stages of pregnancy it conforms itself to the changing contours of the breast areas while assuring comfort to the wearer under all conditions of use. This brassiere, however, is not a nursing bra.

The French patent to Chauvin concerns an unconventional type of brassiere for nursing mothers which is in the form of a flat type bra having no real discernable breast cup structures. Elastic or other stretchable material suitably forms overlying flaps, one of which is harnessed with the yoke strap so that it can be pulled down while the other flap is pushed upwardly to expose a breast to be nursed. Although this brassiere employs no snaps or other hooks to uncup a breast cup, both flaps must be moved oppositely to each other to reveal a breast; and the breasts cups do not have any defined shape as no cup seams are employed to fabricate the flaps.

Commonly-assigned co-pending U.S. Ser. No. 536,854 filed Sept. 28, 1983 discloses a brassiere having openable cups which do not require fastening means. The cups are each constructed with an upper cup portion and a "fold-over" portion. These portions are joined together along a seam which takes in material from both portions. This construction creates an overlapping of material which creates a "bulky" look. In addition, the "fold-over" cup portion is loosely held in place and thus, is easily pulled away from the body during normal wear which does not provide for sufficient support of the breasts. The construction of the present invention allows for a less bulky line which is aesthetically desirable. In addition, the cups do not pull away from the wearer's body due to normal wear and tension, which provides for better support of the breasts and increased comfort to its wearer.

OBJECTS OF THE INVENTION

It is therefore, a primary objection of the invention to provide for a brassiere with openable cups which do not require any hooks, snaps, or other fastening means.

It is a further object of the present invention to provide for a brassiere with openable cups, wherein the outline of the bra against the wearer's body does not exhibit any pull away affects and the bra has smooth lines which aid in the comfort of the wearer and create an aesthetically pleasing affect. In addition, the lines of the brassiere should not be distracting nor should the bra employ any inside straps or elastic harness within the bra cups, and the nursing brassiere of the present invention should in overall appearance and detail be no different in looks and function than a regular, ordinary bra, except for the fact that one or both cups are operable.

Another object of the present invention is to provide for a brassiere with openable cups wherein the construction of the frame of the brassiere which incorporates the openable cups is just what a woman is used to wearing at all times as with her regular (non-maternity) brassieres; and to provide at the same time for the increased dexterity of the wearer while opening and/or closing the cup for nursing. The bra should also be comfortable to the wearer and create an aesthetically pleasing affect.

It is another object of the present invention to provide for a brassiere with openable cups wherein the construction of the "fold-over" portion provides for sufficient support of the breast so as to preclude this portion of the brassiere from pulling away from the body during wear.

It is yet another object of the present invention to provide for a brassiere which has as much, if not more, support as a regular brassiere, as in the case of a pregnant or nursing woman such support is vital because of breast enlargement and sensitivity during such time period.

It is yet a further object of the present invention to provide for a brassiere which can comfortably expand and contract as do a nursing mother's breasts. This ability to expand and contract is derived from the stretchable material which is utilized, and which material also facilitates the opening and closing of the cup panels.

SUMMARY OF THE INVENTION

The present invention is a brassiere having openable cups. The main inventive feature of the invention is that opening and closing of the cups does not require any fastening means, such as hooks or snaps.

Each cup of the brassiere is constructed of at least two panels and defined by the individual panels of the bra cup. A "fold-over" panel and an underbust panel, to which it is fixably attached, define the outer panel. An upperbust panel which is fixably attached to the "fold-over" panel and the underbust panel define the inner panel. The "fold-over" panel may be folded and/or deformed and/or stretched so as to open the cup along the open cleavage edge of the "fold-over" panel which overlays the upperbust panel. It should also be noted that the foldover panels and the underbust panels may be combined into a single piece to form the outer panel in a modification or variation of the invention.

The "fold-over" panel and the upperbust panel which comprise the openable portion of the invention are attached to the cup means along the center cup seam. The upperbust panel portion of the cup means is joined to the corresponding portion of the adjacent cup along the cleavage seam. The "fold-over" panels abut each other at the center seam. This provides for a construction whereby the "fold-over" panel will not loosen and expose the breast during normal wear. This construction also provides for support for the breast since the "fold-over" panel will not pull away from the upperbust portion due to the weight and force of the breast against it, but rather, will uplift and support the breast.

In addition, due to this "freely-folding" construction, the outline of the wearer's body does not exhibit any pull away affects and the bra has smooth lines which aid in the comfort of the wearer and creates an aesthetically pleasing affect.

This construction also provides for the shape of the overall bra which incorporates the openable cups to be closer in appearance and construction to what a woman is used to wearing, which provides for the increased dexterity of the wearer while opening and/or closing the cups; aids in the comfort of the wearer and creates an aesthetically pleasing affect.

DETAILED DESCRIPTION OF THE PREFERRED EMBODIMENTS

Figure 1:
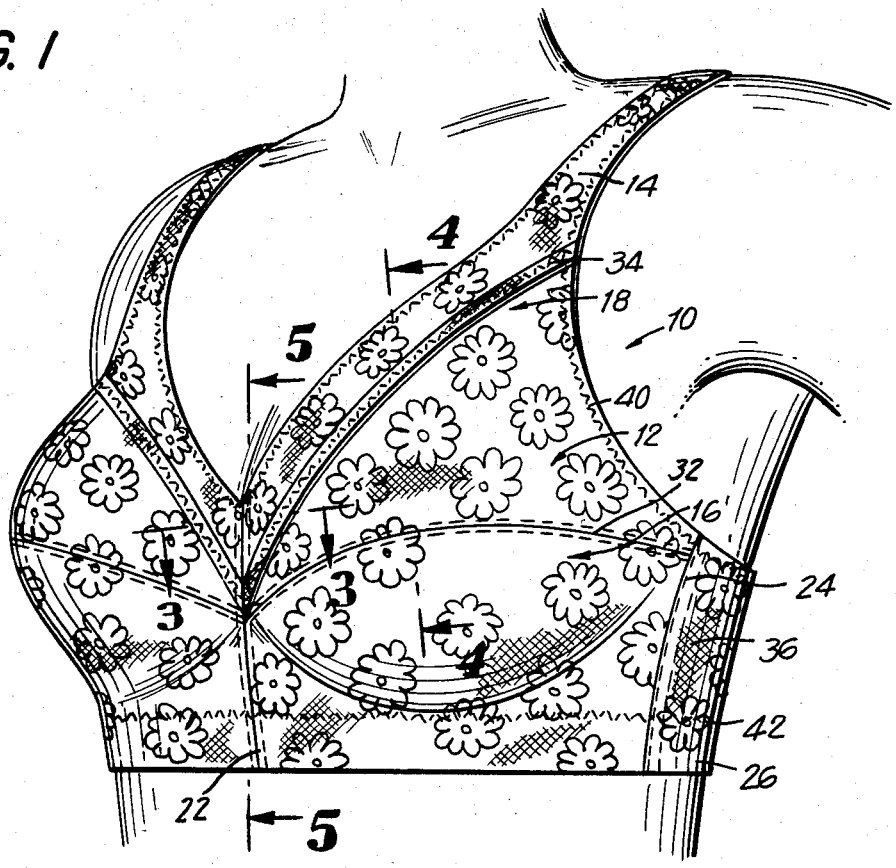
FIG. 1 is a front perspective view of the embodiment of the invention, shown on the body of the wearer.

The present invention is a brassiere 10 having openable cups 12. Each bra cup 12 is formed of at least two panels. These include an optional upperbust panel 14, an inter-mediate or "fold-over" panel 18 and an underbust panel 16. For purposes of this specification, this embodiment is considered to comprise at least two panels. The openable cups 12 do not require any fastenings means, such as hooks or snaps. The brassiere is comfortable; easy to use; asthetically pleasing and provides support for the breasts. It can be conveniently worn during maternity, during nursing, or the nursing bra can be used as a "conventional" bra.

The brassiere 10 consists generally of a pair of bra cups 12 connected to each other along a cleavage seam 22, two connecting back panels 36 attached to an outside edge of each bra cup 12 along an underarm side seam 24, and fastening means 30 for fastening cooperating ends of the two connecting back panels 36 to each other. Shoulder straps 20 joining the bra cups 12 to the connecting back panels 36, and an underbust band 26 secured along both the lower edge of bra cups 12 and the connecting back panels 36 are optionally provided. It is to be understood that the term "fold-over", as used herein, is to be construed in the broadest possible sense of the word. Although the "fold-over" panel of the cup may not actually fold so as to expose a breast, a panel is considered to be a "fold-over" panel if it can be stretched to or deformed in any way so as to open the cup. The material which comprises the cup can be stretchable in at least one direction and in the preferred embodiment as shown, is stretchable in the horizontal and diagonal directions, but is less stretchable in a vertical direction.

As shown in FIGS. 1 through 6, the upperbust panel 14 is suitably shaped like an elongated hexagon with three short sides and three long sides. The short sides occur at the cleavage seam 22, the center cup seam 32, and at the shoulder strap connection 38. The upperbust panel 14 is formed of any suitable omni-directional stretchable material such as a stretchable cotton or lace containing Spandex, a trademark of U.S. Rubber Lycra, a trademark of the Dupont Company, or other like stretchable material.

The "fold-over" panel 18 is generally triangular in shape, and may likewise be formed of any suitable omni-directional stretchable material.

The underbust panel 16 is generally quadrilateral in shape, and it also is be formed of any suitable omni-directional stretchable material such as cotton or lace. If desired lace with a suitable backing layer, such as a cotton backing layer, or a single ply-material, such as polycotton or Spandex may be an alternate material. The underbust panel 16 is also preferably stretchable in all directions, but due to "double layer" construction, it is not as stretchable as the "fold-over" panel 18.

Figure 3:
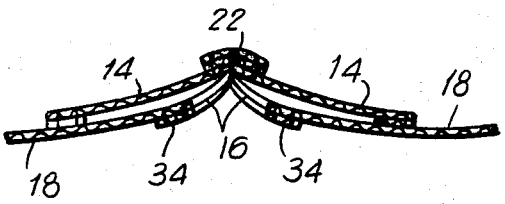
FIG. 3 is a cross-sectional view of the brassiere taken along line 3—3 of FIG. 1.
Figure 4:
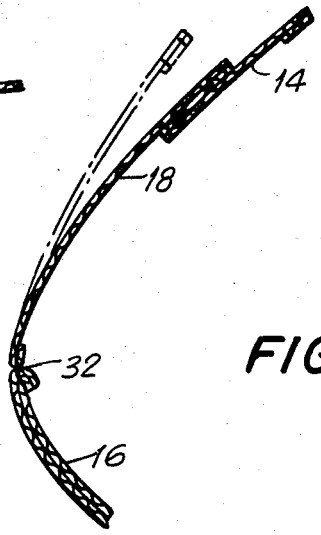
FIG. 4 is a cross-sectional view of the brassiere taken along line 4—4 of FIG. 1.
Figure 5:
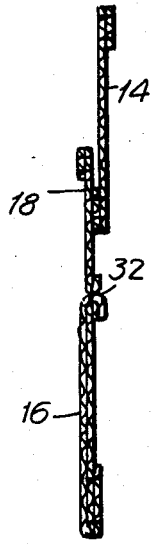
FIG. 5 is a cross-sectional view of the brassiere taken along line 5—5 of FIG. 1.
Figure 6:
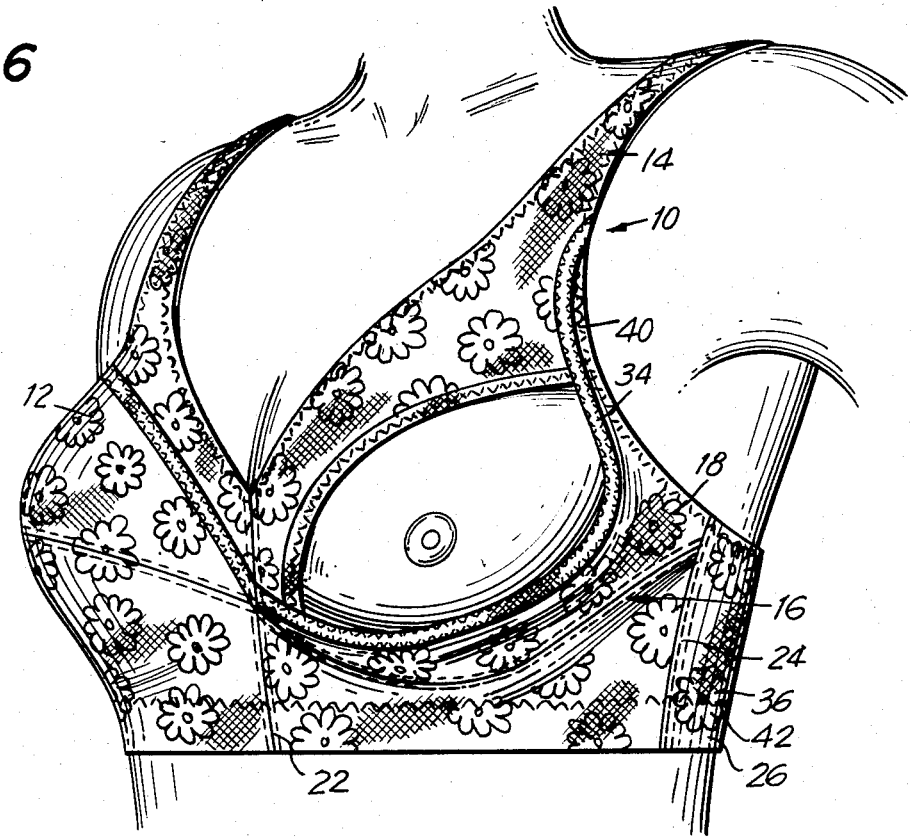
FIG. 6 is a front perspective view of the brassiere of FIG. 1 shown on the body of the wearer with one of the bra cups shown in an open portion.

As best shown in FIGS. 3–5, the "fold-over" panel 18 is connected, preferably by stitching, to the underbust panel 16 along and/or adjacent to the center cup seam 32. The upperbust panel 14 is also connected to the underbust panel 16, preferably by stitching, along the center cup seam 32. The two underbust panels 16 are joined, preferably by stitching, to each other along the cleavage seam 22. The two upperbust panels 14 are joined, preferably by stitching, to each other along the cleavage seam 22. In FIG. 6, both the upper and lower portions of cup 12 (16 and 18) fold down to expose the entire breast and nipple for nursing.

Figure 2:
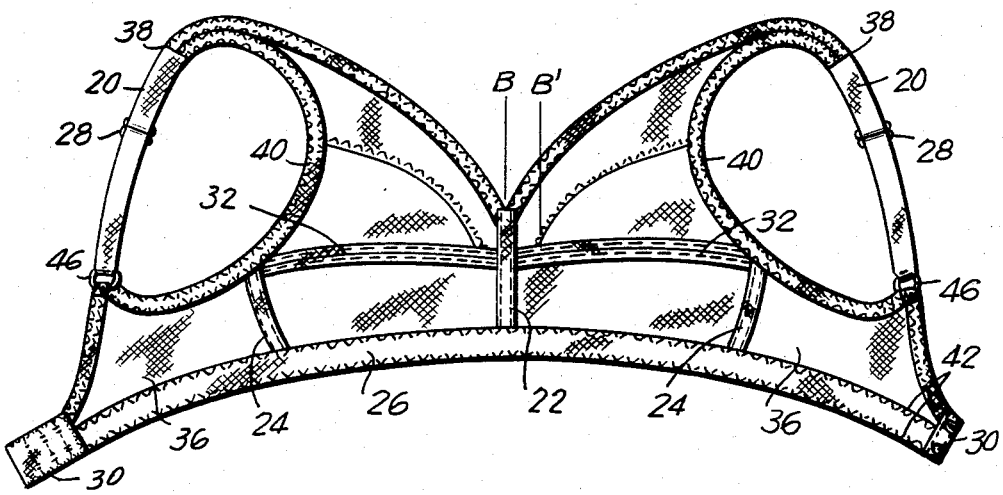
FIG. 2 is a planar view showing the inside of the brassiere of FIG. 1.

As shown more particularly in FIG. 3, the two "fold-over" panels 18 are joined to each other adjacent and/or at their exposed edge 34, at the intersection of the cleavage seam 22. Each fold over panel 18 is also joined to the center cup seam 32 and joined to the underbust panel 16 along at the center cup seam 32. In addition, the fold over panels 18 are further joined at the underarm edges 40 to the upperbust panels 14. The upperbust panel 14 is also connected to the underbust panel 16 along the center cup seam 32. The two underbust panels 16 are joined, preferably by stitching, to each other along cleavage seam 22. As best shown in FIG. 2, the upperbust panel 14 and the "fold-over" panel 18 and the underbust panel 16 are joined together along the center cup seam along line B—B'. The length of the seam shown along the line B—B' is generally less then the width of the upperbust panel 14, so as to provide greater fold-over and more accessibility to the breast. Alternatively, the joining of such panels may be only at the middle cleaving seam. Such construction is unique, and exhibits characteristics of ordinary bras while at the same time provides the wearer with a bra suitable for nursing.

As shown in phantom in FIG. 4, and as best shown in FIG. 6, this provides for a "freely-folding" construction, in which the exposed edge 34 of the "fold-over" panel 18 which overlaps the underbust panel 14 is not attached to any other portions of the brassiere. Due to this "freely-folding" construction, the "fold-over" panel 18 can be stretched or deformed in any way so as to open the cup without deforming or stretching the upperbust panel 14. In addition, the stretching or the deforming of the "fold-over" panel 18 is not restrained by interference caused by the attachment of the upperbust panel 14 to the "fold over" panel 18. This "freely-folding" construction also provides for the upperbust panel 14 not to be deformed and to remain in place against the body when the "fold-over" panel 18 is stretched or deformed during use. This allows for the upperbust panel 14 to continue supporting the breasts with an equal lift when tension is applied while either nursing cup is opened during use.

This "freely-folding" construction also provides for sufficient support of the breasts so as to preclude either or both "fold-over" panels 18 from pulling away from the body during water. Thus, the outline of the wearer's body does not exhibit any pull away affects and the bra has smooth lines which aid in the comfort of the wearer and create an aesthetically pleasing affect, which bra also appears both to the wearer and others as no different than any regular non-nursing bra.

This "freely-folding" construction provides for the shape of the overall bra which incorporates the openable cups to be closer in appearance to what a woman is used to wearing. This provides for the increased dexterity of the wearer while opening and/or closing the cups; aids in the comfort of the wearer and creates an aesthetically pleasing affect.

As best shown in FIG. 2, shoulder strap 20 are optionally connected to the top end of the upperbust panel 14 at the shoulder strap connection 38. Straps 20 are connected at their lower end to connecting back panels 36. The "freely-folding" construction provides for the shoulder straps to continue supporting the breasts with an equal lift while the cup is opened. Straps 20 are connected to the upperbust panel 14 at shoulder strap connection 38 preferably by means of stitching. The lower connection to connecting back panel 36 may be by any suitable means, such as by stitching or by a suitable connector means, such as a ring member 46. In this embodiment, a portion of connecting back panel 36 extends through the ring member 46 and is joined to itself on the opposite side.

Shoulder strap 20 may be of any suitable material and is, most preferably, formed of elastic which is stretchable in a longitudinal direction only. The elastic may be then adapted to move through a strap adjusting means 28, preferably comprising a buckle, in order to change the length of the strap 20.

As best shown in FIG. 2, underbust band 26 extends along the entire lower edge of the brassiere 10. It is fixably attached, preferably by stitching, along the lower edge of the underbust panel 16 of each bra cup and along the connecting back panels 36 at the bottom portion. Underbust band 26 itself is stretchable primarily only in a longitudinal direction and provides support for the breasts. The underbust band 26 is fixably attached to the brassiere 10, preferably by a "zigzag"

stitching 42 so as to allow the underbust band 26 and the material to which it is stitched, either the underbust panel 16 or the connecting back panel 36, to stretch in a horizontal direction.

As best shown in FIG. 6, in use, the "fold-over" panel 18 can be folded down in order to expose a nipple, for example, for nursing. This simple arrangement has the advantage that the "fold-over" panel 18 can be easily stretched or deformed with one hand and a baby or some other object can be held in the other hand. Although the bra 10 can be shown with one cup only, it is to be understood that both cups can be open, either at different times or at the same time.

Molded cups are also considered to be within the scope of the invention. A molded panel can be used in place of the "fold-over" panel 18 and the underbust panel 16. Such preformed molded cups would, of course, be elastic and resilient to conform to the shape of a breast, while at the same time be capable of opening and closing along the upper bust panel in in manner similar to the bra cup shown herein, formed of the underbust panel and the foldover panel.

Although the style of the cups 12 for brassiere 10 have been described in terms of certain specific embodiments and shapes of the panels, it is to be understood that any bra cup having a "fold-over" panel which does not employ any fastening means is to be considered to be within the scope of this invention. Fastening means include hooks, snaps, zippers, Velcro fasteners, buttons, or any other device used for the purpose of fastening one piece of material to another.

In an alternate embodiment, shown in FIGS. 7 through 12, the pair of "fold-over" panels 118 are not joined to each other at the intersection of the center cup seam 132 and cleavage seam 122, but rather each are joined to the underbust panel 116 and the upperbust 114 along a portion of the center cup seam 132, so that the intersection of the cleavage seam 122 and the center cup seam 132 does not stitch through the exposed edge 134 of the "fold-over" panel 118.

Figure 8:
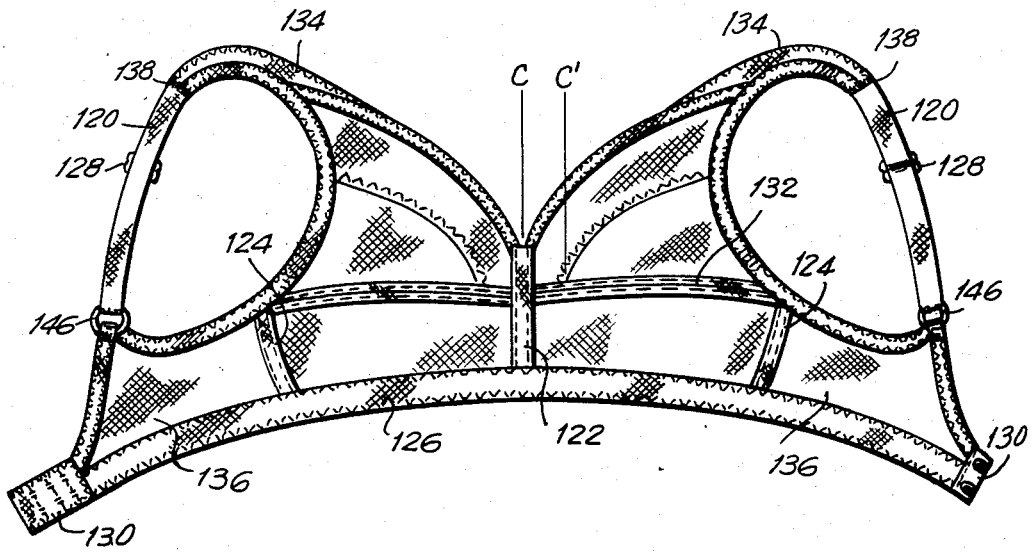
FIG. 8 is a planar view showing the inside of the alternate embodiment of the invention.
Figure 9:
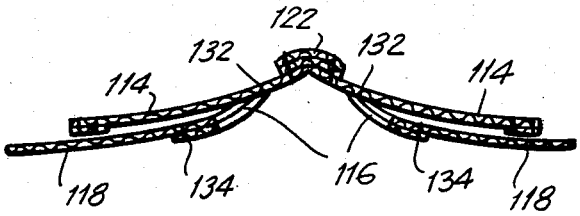
FIG. 9 is a cross-sectional view of the alternate embodiment of the invention taken along line 9—9 of FIG. 7.
Figure 10:
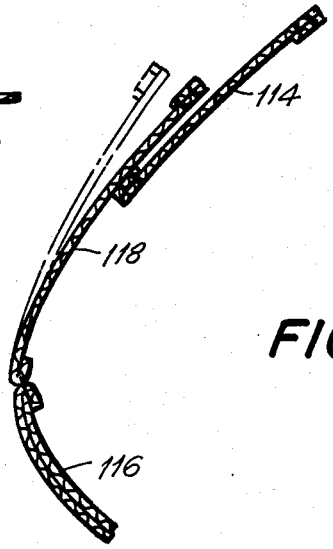
FIG. 10 is a cross-sectional view of the alternate embodiment of the invention taken along line 10—10 of FIG. 7.
Figure 11:
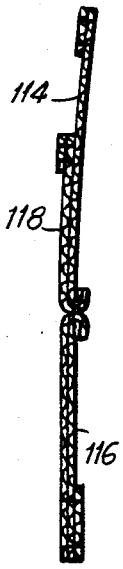
FIG. 11 is a cross-sectional view of the alternate embodiment of the invention taken along line 11—11 of FIG. 7.

As best shown in FIGS. 9–11, the "fold-over" panel 118 is connected, preferably by stitching, to the underbust panel 116 at center cup 132. The upperbust panel 114 is also connected to the underbust panel 116, preferably by stitching, to the center cup seam 132. The two underbust panels 112 are joined, preferably by stitching, to each other along the cleavage seam 122. As best shown in FIG. 8, the upperbust panel 114 and the "fold-over" panel 118 and the underbust panel 116 are joined together along the center cup seam 132 along line C—C'. The width of line C—C' corresponds to approximately about the width of the upperbust panel 114. This provides for a "freely-folding" construction, in which the exposed edge 134 which overlaps the underbust panel 116 is not attached to any other portions of the brassiere. Due to this "freely-folding" construction, the "fold-over" panel 118 can be stretched or deformed in any way so as to open the cup without deforming or stretching the upperbust bust 114. In addition, the stretching and/or deforming of the "fold-over" panel 118 is not restrained by interference caused by the attachment of the underbust and/or upperbust panels to the "fold-over" panel 118. This "freely-folding" construction also provides for the upperbust panel 114 not to be deformed and to remain in place when the "fold-over" panel 118 is stretched or deformed during use. This allows for the upperbust panel 114 to continue supporting the breasts with an equal lift when tension is applied while the cup is open during use.

This "freely-folding" construction also provides for sufficient support of the breasts so as to preclude this "fold-over" panel 118 from pulling away from the body during wear. Thus, the outline of the wearer's body does not exhibit any pull away affects and the bra has smooth lines which aid in the comfort of the wearer and create an aesthetically pleasing affect.

Shoulder straps 120 are optionally connected to the top and of the "fold-over" panel 118 at the shoulder strap connection 138. Straps 120 are connected at their lower end to the connecting back panels 136. The "freely-folding" construction provides for the shoulder straps to continue supporting the breasts with an equal lift while the cup is opened. Straps 120 are connected to the "fold-over" panel 118 at the shoulder strap 138 preferably by means of stitching. The lower connection to connecting back panel 136 may be by any suitable means, such as by stitching or by a connector or by a ring member 146. In this embodiment, a portion of the connecting back panel 136 extends through the ring member 146 and is joined to itself on the opposite side.

Shoulder strap 120 may be of any suitable material and is, most preferably formed of elastic and is stretchable in a longitudinal direction only. The shoulder strap may then be adapted to move through a strap adjusting means 28, preferably comprising a buckle, in order to change the length of strap 120.

Underbust band 126 extends along the entire lower edge of the brassiere 110. It is fixably attached, preferably by stitching along the lower edge of the panel 116 of each bra cup and along the connecting back panels 136 at the bottom portion. Underbust band 126 itself is stretchable primarily only in a horizontal direction or transversely of the user's body and provides support for the breasts or weighted prosthesis. The underbust band 126 is fixably attached to the brassiere 110, preferably by zig zag stitching, so as to allow the underbust band 126 and the material to which it is stitched, either the underbust panel 116 or the connecting back panel 136, to stretch in a longitudinal direction. Stretch of the bra cups 112 of the connecting back panel 136 is limited in the vertical and diagonal directions by the underbust band 126.

Stretch of the band cups 112 and the connecting back panels 136 is limited in the vertical and diagonal directions by the underbust band 126.

Figure 7:
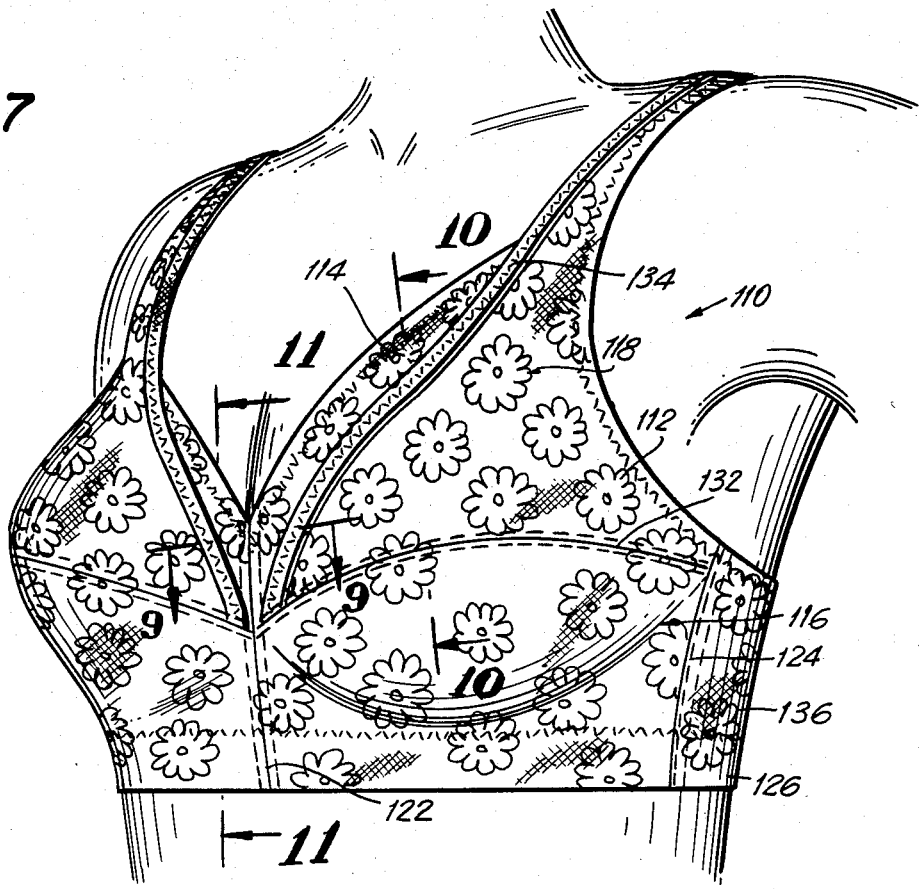
FIG. 7 is a perspective view of an alternative embodiment of the invention.
Figure 12:
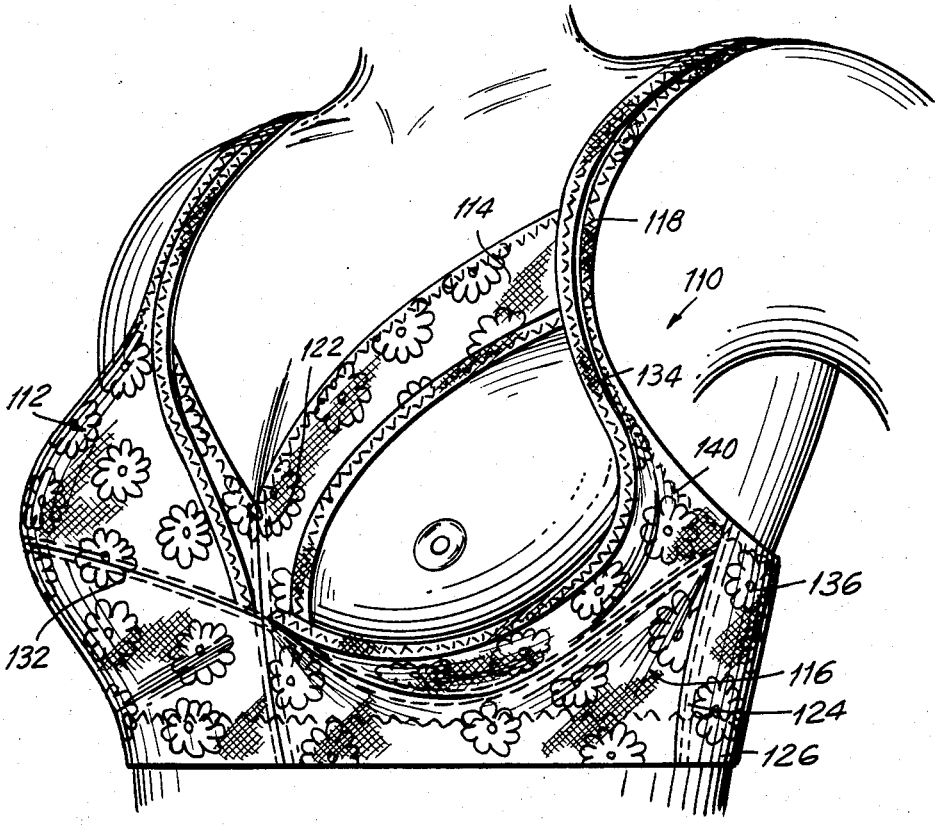
FIG. 12 is a perspective view of the alternate embodiment of the invention of FIG. 1 shown on the body of the wearer with one of the brassiere cups shown in an open position.

As best shown in FIGS. 7, 8 and 12, the upperbust panel 114 is elongated and shaped as pentagonal with three short sides and two long sides. The three short sides occur at the cleavage seam 122, the center cup seam 132, and at the shoulder strap connection strap 128. The upperbust panel 114 is formed of any suitable omni-directional stretchable material such as cotton or lace.

The "fold-over" panel 118 is generally four sided with one short side and three long sides. The short side occurs at the shoulder strap connection 128, and the long sides occur at the center cup seam 132, the underarm seam 140 and the exposed edge 134. It again, may be formed of any suitable omni-directional stretchable material.

The underbust panel 116 is generally pentagonal in shape. Once again, it may be formed of any suitable omni-directional suitable material such as cotton and lace; preferably lace with a suitable backing layer such as a cotton backing layer, or a single-ply material such as polycotton or Spandex. The underbust panel 116 is also preferably stretchable in all directions, but not as stretchable as the "fold-over" panel 118.

Bra cups constructed in accordance with this alternate embodiment of the present invention have inner and outer panels defined by the individual panels of the bra cup. The "fold-over" panel 118 and the underbust panel 116 to which it is fixably attached, define an "outer panel"; the upperbust panel 114 which is connected to the "fold-over" panel 118 and the underbust panel 116 define an "inner panel".

Due to the "freely-folding" construction, these panels closely overlay one another which provides for the outline of the wearer's body not to exhibit any pull away affects and the bra has have smooth lines which aid in the comfort of the wearer and create an aesthetically pleasing affect.

As best shown in FIG. 12, in use, the "fold-over" panel 118 can be folded down to expose a nipple, for example, for nursing. This simple arrangement has the advantage that the "fold-over" panel 118 can be easily stretched or deformed with one hand and a baby or some other object can be held in the other hand. Although the bra 110 can be shown with one cup only, it is to be understood that both cups can be open, either at different times or at the same time.

This "freely-folding" constructon also provides for the overall bra which incorporates the openable cups to be closer in appearance to what a woman is used to wearing. This provides for increased dexterity of the wearer while fastening and/or unfastening the cups which aids in the comfort of the wearer and creates an aesthetically affect.

It should also be recognized that other than the upper bust cup panel in effect being divided into two separate upper cup panels, the nursing bra of the present invention is just like a conventional bra. Also, the upper cup panel which is pulled down is cut on an angle which is such as to automatically return to its normal position and shape upon release of same, while at the same time exhibiting a wide enough access opening and staying in the pulled down position when in a nursing condition. When in use, the nursing bra of the invention has a breast opening which is arge enough to expose the breast without the need for holding the panel down, the bra construction and materials thereof themselves being sufficient to maintain the breast opening at all times once the cup is opened to expose the breast.

Although the present invention has been described in some detail by way of illustration and example for purposes of clarity and understanding it will, of course, be understood that various changes and modifications may be made in the form, details, and arrangements of the part without departing from the scope of the invention of the following claims.

What is claimed is:

1. A nursing brassiere comprising a pair of breast cups connected to side panels and shoulder strap means; each of said breast cups having an underbust panel, an upperbust panel and a fold over panel; said fold over panel at least partially overlying said upperbust panel; at least one edge of said fold over panel being unattached to any other panels so as to enable said fold over panel to be stretched or deformed by pulling generally downwardly, on said fold over panel, thereby opening said breast cup and exposing a breast.

2. A brassiere as claimed in claim 1, wherein said fold over panel is connected to the upperbust panel and to the underbust panel, so as to provide an upper edge forming part of said foldover panel which is not attached to said upperbust panel.

3. A brassiere as claimed in claim 1 including a pair of back panels and fastening means for connecting said back panels to each other.

4. A brassiere as claimed in claim 3, wherein an underbust band is secured along a lower edge of said bra cups and said connecting back panels.

5. A brassiere as claimed in claim 3, including an underbust band which is secured to said underbust panels and to said back panels.

6. A brassiere as claimed in claim 3, including shoulder straps and means for adjusting the length of said shoulder straps.

7. A brassiere as claimed in claim 6, including loop means for connecting said shoulder straps to said connecting back panels.

8. A brassiere as claimed in claim 1, wherein said fold-over panel is made of a material which is stretchable in at least one direction.

9. A brassiere as claimed in claim 1, wherein said fold-over panel is stretchable a maximum along the diagonal and less stretchable orthogonally.

10. A brassiere as claimed in claim 1, wherein said underbust panel is made of a material which is stretchable in all directions.

11. A brassiere as claimed in claim 1, wherein said upperbust panel is made of a material which is stretchable in all directions.

12. A brassiere as claimed in claim 5, wherein said underbust band is secured by zigzag stitching to said underbust panels and said the connecting back panels so as to stretch in a horizontal direction.

13. A brassiere as claimed in claim 1, wherein said fold-over panels, said underbust panels and said upperbust panels are attached to each other along a cleavage seam.

14. A brassiere as claimed in claim 13, wherein said fold over panels, said unberbust panels and said upperbust panels are attached to each other along a center cup seam.

15. A brassiere as claimed in claim 14, wherein the line of attachment along the center cup seam is approximately equal to about the width of said upperbust panel.

16. A brassiere as claimed in claim 2, wherein said underbust panels, and said upperbust panels are attached to each other along a cleavage seam.

17. A brassiere as claimed in claim 16, wherein said underbust panels, said upperbust panels and said fold-over panels are attached to each other along a center cup seam.

18. A brassiere claimed in claim 17, wherein the line of attachment along the center cup seam is approximately equal to about the width of the upperbust panel.

19. A brassiere as claimed in claim 1, wherein all of said panels are of a stretchable material, such as cotton or lace.

20. A brassiere as claimed in claim 1, wherein anyone said panels may comprise a lace materia having a backing layer, such as cotton.

21. A brassiere as claimed in claim 1, wherein any of said panels may comprise a single-ply material, such as a polycotton.

* * * * *